United States Patent [19]

Van Sloun

[11] Patent Number: 4,854,239

[45] Date of Patent: Aug. 8, 1989

[54] SELF-STERILIZING SAFE-ARM DEVICE WITH ARM/FIRE FEATURE

[75] Inventor: Peter H. Van Sloun, Hopkins, Minn.

[73] Assignee: Honeywell Inc., Minneapolis, Minn.

[21] Appl. No.: 256,445

[22] Filed: Oct. 12, 1988

[51] Int. Cl.[4] ..... F42B 23/26; F42C 15/14; F42C 19/00

[52] U.S. Cl. ..... 102/426; 102/229; 102/254; 102/401

[58] Field of Search ..... 102/426, 404, 424, 401, 102/202.1, 254, 229

[56] References Cited

U.S. PATENT DOCUMENTS

| | | | |
|---|---|---|---|
| H281 | 6/1987 | Munach | 102/254 |
| 4,476,784 | 10/1984 | Reynes | 102/424 |
| 4,691,634 | 9/1987 | Titus et al. | 102/229 |
| 4,702,169 | 10/1987 | Gallant | 102/401 |
| 4,712,478 | 12/1987 | Haglund et al. | 102/426 |
| 4,727,809 | 3/1988 | Watson | 102/254 |

FOREIGN PATENT DOCUMENTS

| | | | |
|---|---|---|---|
| 8603827 | 7/1986 | PCT Int'l Appl. | 102/401 |

*Primary Examiner*—David H. Brown

*Attorney, Agent, or Firm*—Roger W. Jensen

[57] ABSTRACT

A safety apparatus to safe or to arm and fire a munition, utilizes a rotor containing an aligned adjacent firing pin and detonator in holes extending completely through the rotor perpendicular to the axis. A first explosively powered piston actuator, when fired, will unlock the rotor and enable a second explosively powered piston actuator, when fired, to rotate the rotor to align the detonator with an explosive charge and to cause a firing pin to fire the detonator. The detonator will fire a transfer lead which, in turn, will fire the main charge. As assembled, a third explosively powered piston actuator is aligned with the detonator and, when fired, will cause the detonator to explode and translate the rotor with part of the axis extending out of the munition where it is held in this position to indicate a safe condition.

19 Claims, 11 Drawing Sheets

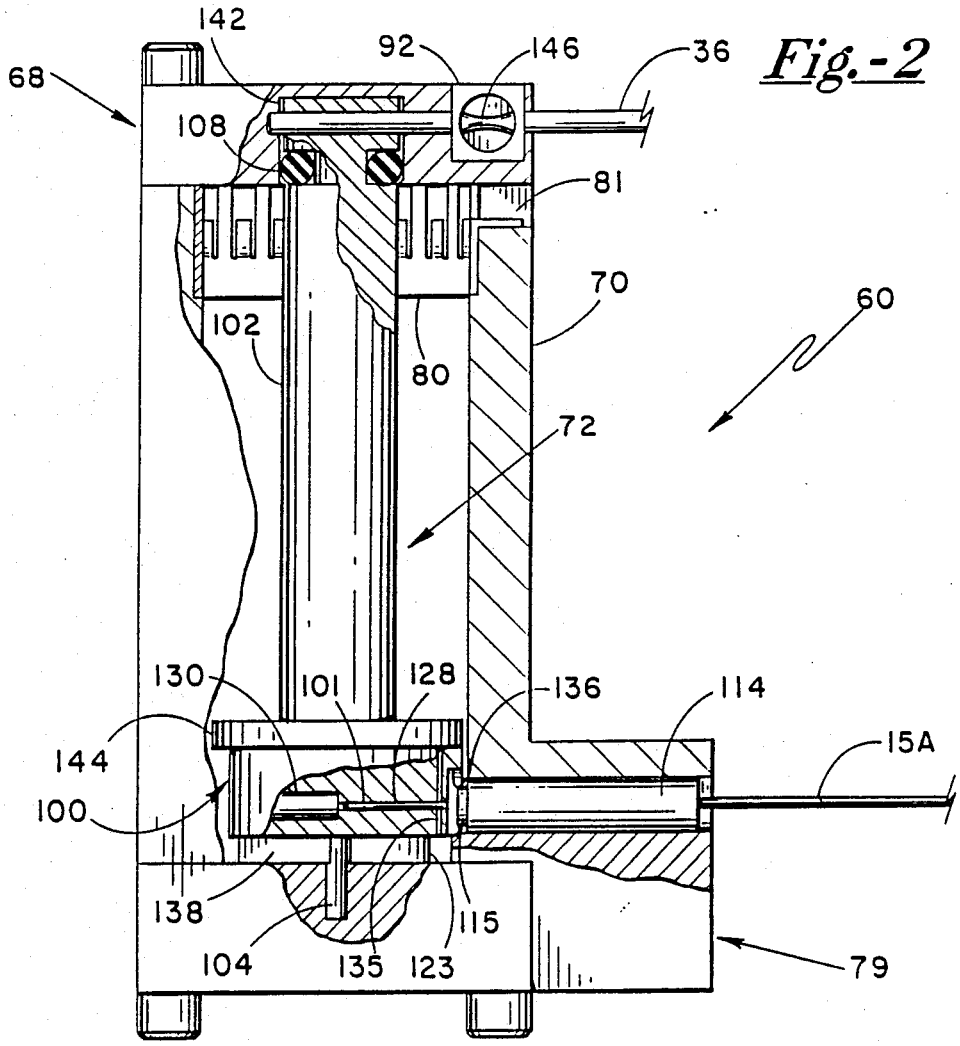
Fig.-2
Fig.-3
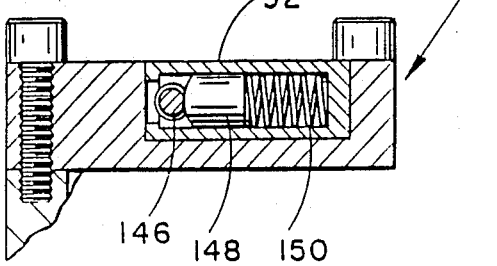
Fig.-4
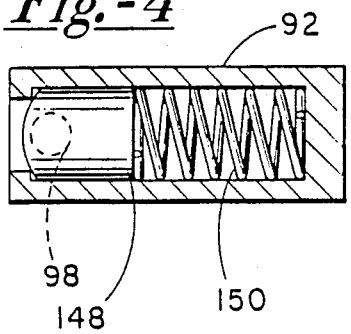

SELF-STERILIZING SAFE-ARM DEVICE WITH ARM/FIRE FEATURE

FIELD OF THE INVENTION

This invention is utilized as a safety device to prevent premature detonation and explosion in portable explosive devices such as hand grenades, pocket mines, and other munitions and to provide a positive indication of a safe condition.

REFERENCE TO RELATED APPLICATIONS

This application is related to the following commonly assigned applications filed concurrently herewith:

| Title | Ser. No. |
|---|---|
| Safety Locking Pull Ring | 256,444 |
| Selectable Lightweight Attack Munition | 256,437 |

BACKGROUND OF THE INVENTION

Earlier U.S. Pat. No. 4,712,478 patented Dec. 15, 1987, Steve Haglund et al, Align at Fire, Safe and Arm, and Power Supply Module for a Land Mine is the pertinent example of prior art in this field.

This invention is a portion of an overall portable munition system and cooperates with other elements which are the subject of the related applications given above. This invention is utilized to provide a safety device to prevent accidental or premature detonation and explosion of the munition while elements of the other inventions cooperate with the action of this invention to provide a complete munition. These related inventions when combined with this invention explain the entire operation of the munition.

SUMMARY OF THE INVENTION

This apparatus provides separate safe, also called self-sterilization and arm/fire functions, for a portable munition. The apparatus utilizes a number of interrelated mechanical operations driven by three explosively powered pistons to perform these functions. A first and second piston must both be fired in numerical sequence to cooperate in enabling and then arm/firing the munition. A third piston is used to place the munition in a safe condition where it cannot be fired. The functions are mutually exclusive in that after the first and second pistons are exploded to enable and arm/fire the munition the third piston has no effect, and conversely, after the third piston is fired to safe the munition the first and second pistons have no effect.

The primary element of this invention is a rotor which can rotate about its axis and is contained within a cylinder enclosure. A base of the cylinder enclosure has a cut out to provide access to the rotor. A detonator and firing pin are mounted within adjoining aligned holes completely through the rotor at the base end. The explosively powered pistons and associated linkage are mounted on a cylinder base adjacent to the cylinder cut-out and perpendicular to the rotor axis. As assembled the firing pin is aligned with the third piston mounted in a cylinder base perpendicular to the rotor and the detonator is blocked by the cylinder wall. Firing the third piston, with the rotor in this position, will cause the firing pin to fire the detonator but the resulting explosion will be contained by the cylinder wall. An outer portion of the rotor, which is adjacent the detonator bore, is made weak enough that this explosion can blast an opening in the rotor. The cylinder and rotor are arranged such that this explosion will then cause the rotor to translate away from the cylinder base and drive a post, which is integral to the rotor through a weakened cap over the rotor axis on the opposite end. A spring mounted within the cylinder and adjacent the cap captures and holds the rotor in this translated position to keep the post extended through the cylinder cap where it can be seen to act as an indicator. This extended post indicates that the detonator has been fired and that the munition has been placed in a safe or sterilized condition.

The firing mechanism utilizes a cam with a projection which engages a channel in the cylinder base. The cam is guided by the projection within this channel. The second piston actuator when fired is arranged to drive the cam along the cam channel which directs the cam against a bar which is radially attached to the base of the rotor. When the cam strikes this bar it causes the rotor to rotate. The bar strikes a stop after 90 degrees of rotation at which angle the firing pin is aligned parallel with the cam channel. As the cam continues its motion a perpendicular tang extending upward from the rear of the cam can then strike the aligned firing pin to set off the detonator. With the rotor at this 90 degree angle, the detonator is aligned with a transfer lead which is fired by the detonator explosion which in turn fires the main charge.

As assembled, the cam projection is offset from the cam channel into an adjoining chamber which extends sideways from the cam channel. If the second piston actuator were fired with the cam projection offset into this chamber the piston actuator would not strike the cam and consequently the firing sequence would not occur.

The first piston actuator is fired to move an enable transfer link along a channel perpendicular to the cam channel. The link lies over the cam and has two end projections which extend over the cam and a center projection which extends downward and into a recessed channel which is adjacent to the piston of the first piston actuator. When the first piston actuator is fired the piston pushes against the link's downward projection and moves the link in the perpendicular channel which will pull the cam projection from the offset chamber into the cam channel to align the cam projection with the first piston actuator. A locking engagement of the link with the rotor is also removed during the translation.

The enable and arm/fire sequence therefore consists of two steps, a first step where the first piston is fired to move the enable transfer link and align the cam projection with the cam channel, and a second step where the second piston is fired to move the cam projection along the cam channel to arm/fire the munition as described earlier.

A safety wire which extends through openings in the cylinder into a hole in the rotor post must first be removed to permit the rotor to be rotated or translated relative to the cylinder enclosure. A spring loaded plunger covers the access openings after the safety wire is removed to prevent replacement of the wire as such tampering could otherwise compromise the operation of the munition.

DESCRIPTION OF THE DRAWINGS

FIG. 2, cross-section of safe and arm/fire mechanism;

FIG. 3, cross-section of plunger and cap with safety wire in place;

FIG. 4, cross-section of plunger with safety wire removed;

DETAILED DESCRIPTION OF THE PREFERRED EMBODIMENT

Figure 1:
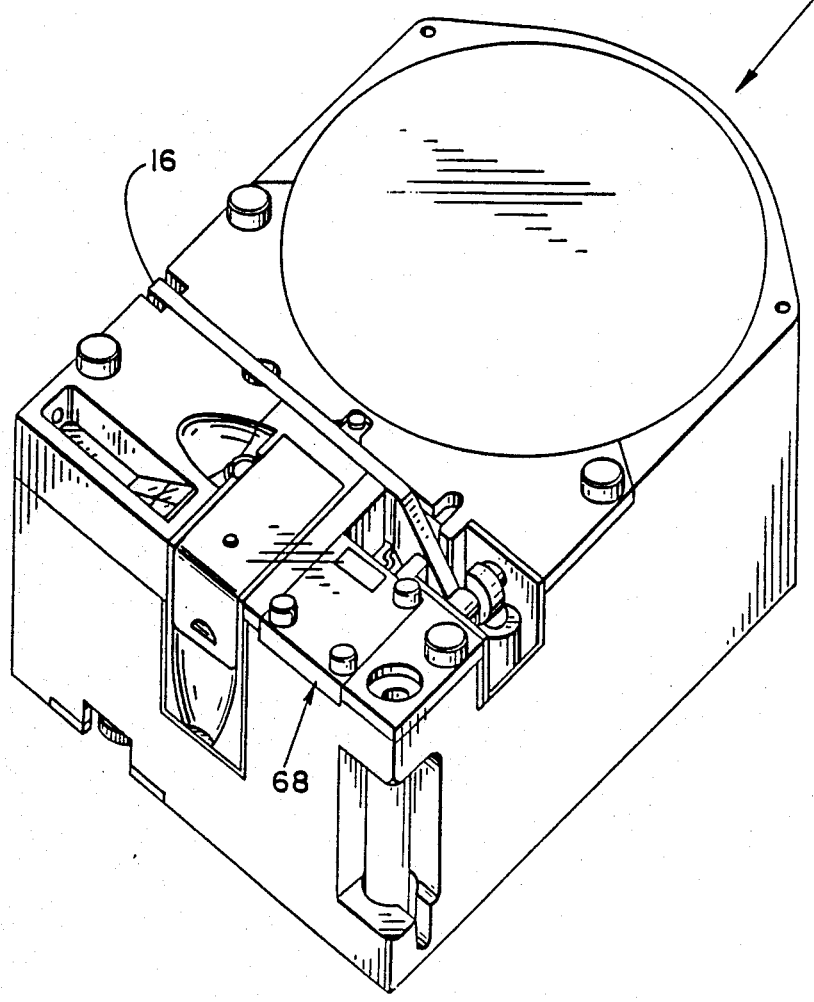
FIG. 1, perspective of munition.
Figure 27:
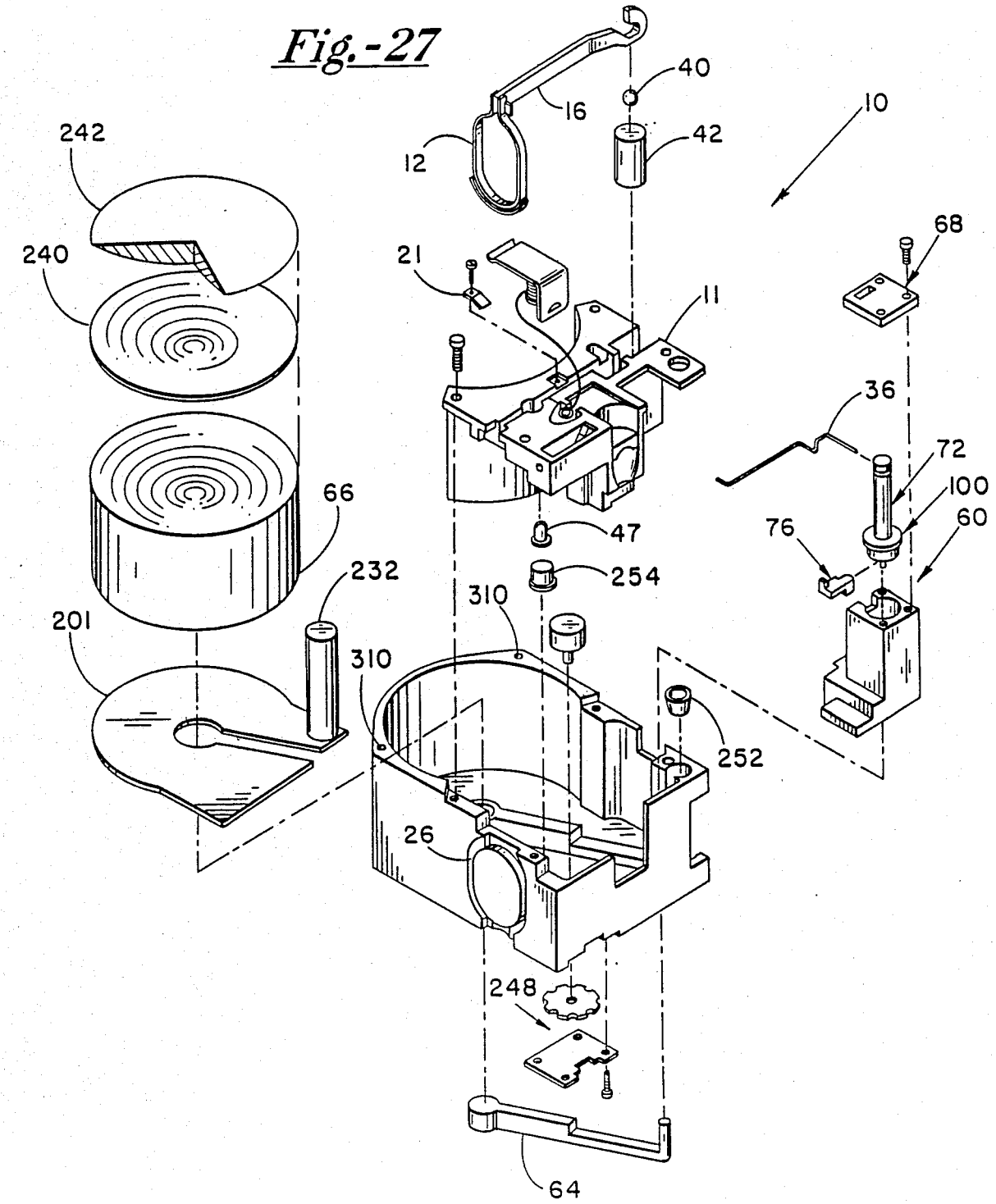
FIG. 27, exploded view of the munition.

FIG. 1 shows a perspective of munition 10 and in FIG. 27 munition 10, locking bar 16, safety wire 36, safe and arm/fire mechanism 60, transfer lead 64, main charge 66, munition cover 11, and locking ring 12 are shown. The use of safety ring 12 and bar 16 in releasing safety wire 36 is described in the copending safety ring patent application referenced earlier. The same numbers are used for identical parts in these applications for ease in cross-reference. The copending patent application describes how the first safety elements cooperate to free safety wire 36.

This invention relates to safe and arm/fire mechanism 60 and the combined safe and arm/fire functions that it provides. When the detonator in mechanism 60 is aligned with transfer lead 64 and fired, this detonates main charge 66. Mechanism 60 also requires electrical impulses from the munition electronics to perform its functions. The operation of the munition electronics in providing these electrical impulses and the munition overall operation are covered in copending patent application Selectable Lightweight Attack Munition referenced earlier.

PHYSICAL DESCRIPTION

Figure 5:
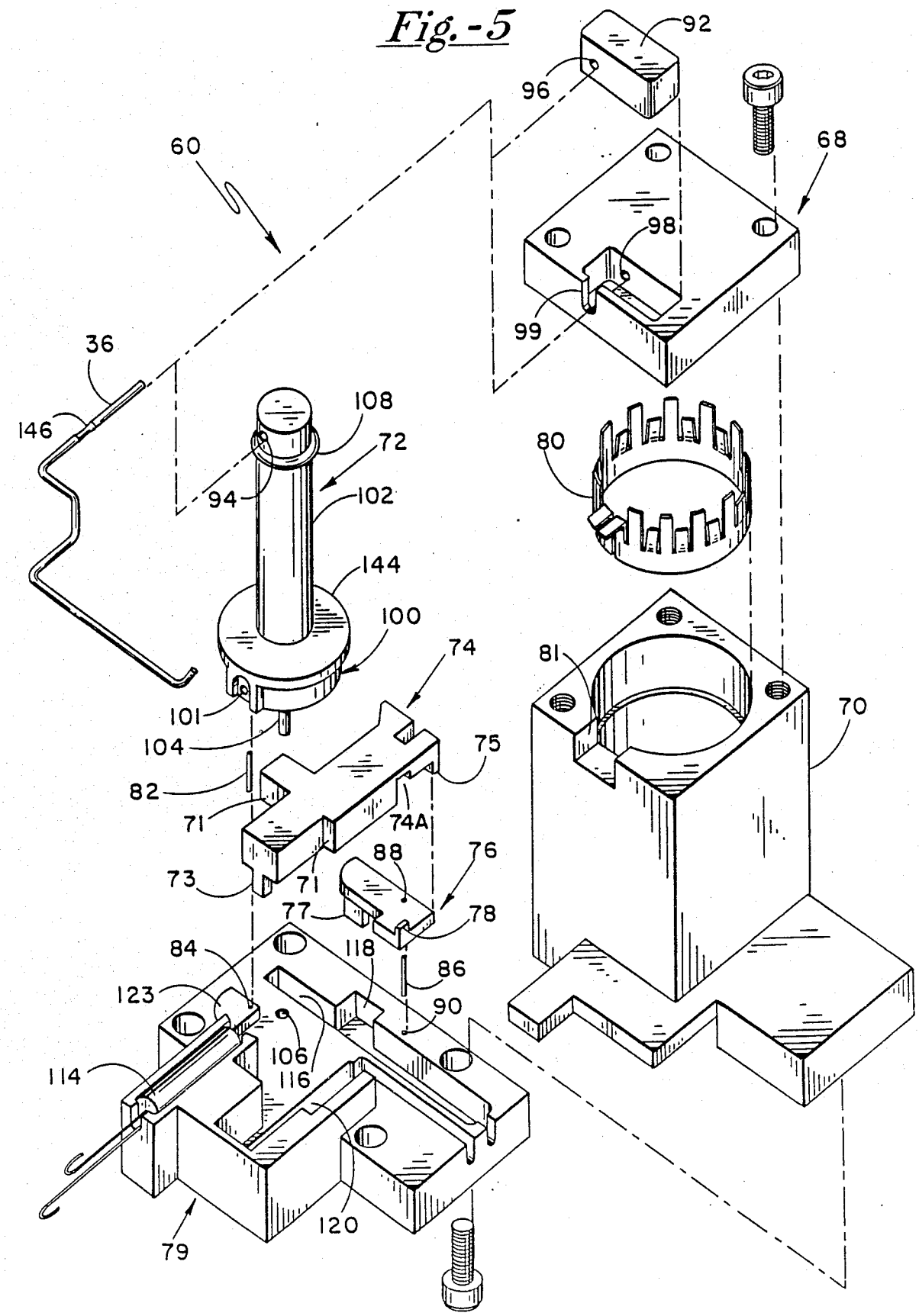
FIG. 5, exploded view of safe and arm/fire mechanism.

FIG. 5 shows the various individual parts of mechanism 60 and interacting safety wire 36. These parts include a cylinder enclosure 70, rotor 72, enable transfer link 74 having stop projections 71, a pair of gripping projections 75, and a piston drive projection 73, an arm and fire cam 76 with a guide projection 77 and firing tang 78, a rotor base 79, and latch spring 80.

A sheer wire 82 which fits within hole 84 in base 79 and a mating hole 84A, not shown in this figure, in rotor 72 when the rotor is in the orientation shown prevents the rotor from turning. A sheet wire 86 extends through hole 88 in cam 76 and into hole 90 in base 79 to secure the cam in place. Safety block 92 is mounted in a mating recess in cap 68. Safety wire 36 fits through notch 99, a hole 96 in block 92, and an aligned hole in the block, not shown, a hole 98 in the recess, and hole 94 in rotor 72. A spring loaded mechanism prevents reinserting safety wire 36 into hole 96 once it has been removed to prevent tampering. This will be described later. Disk 100, post 102, and pin 104 are integral parts of rotor 72. Disk 100 has a radial hole 101 for a firing pin. Pin 104 fits within hole in base 79 as an axis for rotor 72. O-ring 108 fits about post 102 in a groove adjacent to cap 68 to provide a weather seal because of the openings for safety wire 36.

Figure 13:
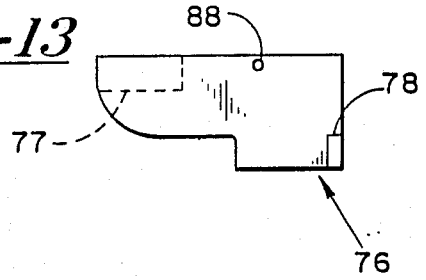
FIG. 13, top view of cam.
Figure 14:
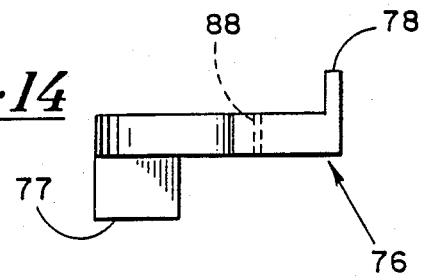
FIG. 14, side view of cam.
Figure 15:
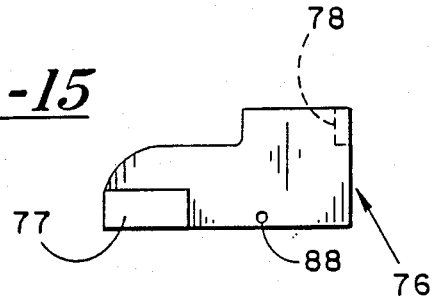
FIG. 15, bottom view of cam.
Figure 16:
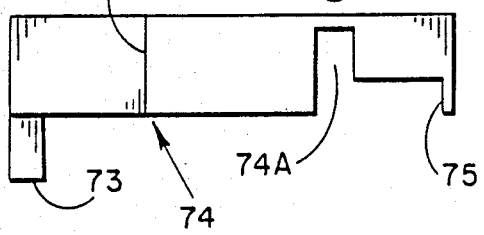
FIG. 16, left side view of enable transfer link.
Figure 18:
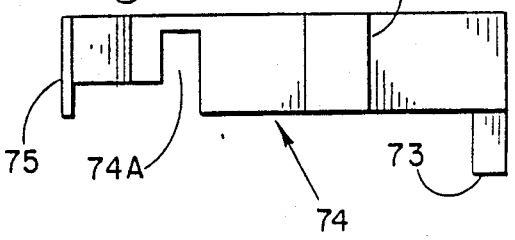
FIG. 18, right side view of enable transfer link.

Referring to FIGS. 13, 14, and 15 details of arm/fire cam 76 with a guide projection 77 and firing tang 78 can be seen more clearly.

Figure 6:
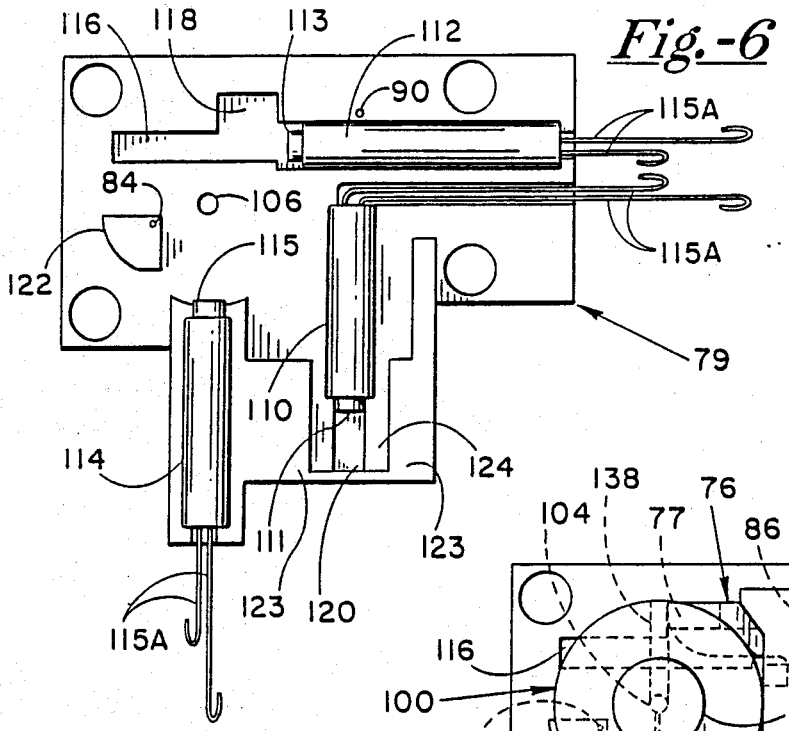
FIG. 6, top view of rotor base with piston actuators installed.

Referring to FIG. 6 base 79 is shown at the first assembly step with explosive piston actuators 110, 112, and 114 totally recessed within slots which are as deep as the piston diameter. Each piston actuator has a pair of wires 115A to fire the actuator electrically. Channel 116 which is centered with and continues from the slot containing piston 112, provides a guide for projection 77 of cam 76. Chamber 118 extending sideways from channel 116 acts as a recess for projection 77 of cam 76 when offset within this chamber. Quadrant 122 provides a stop for rotor 72 when it has rotated 90 degrees from the initial position.

Figure 7:
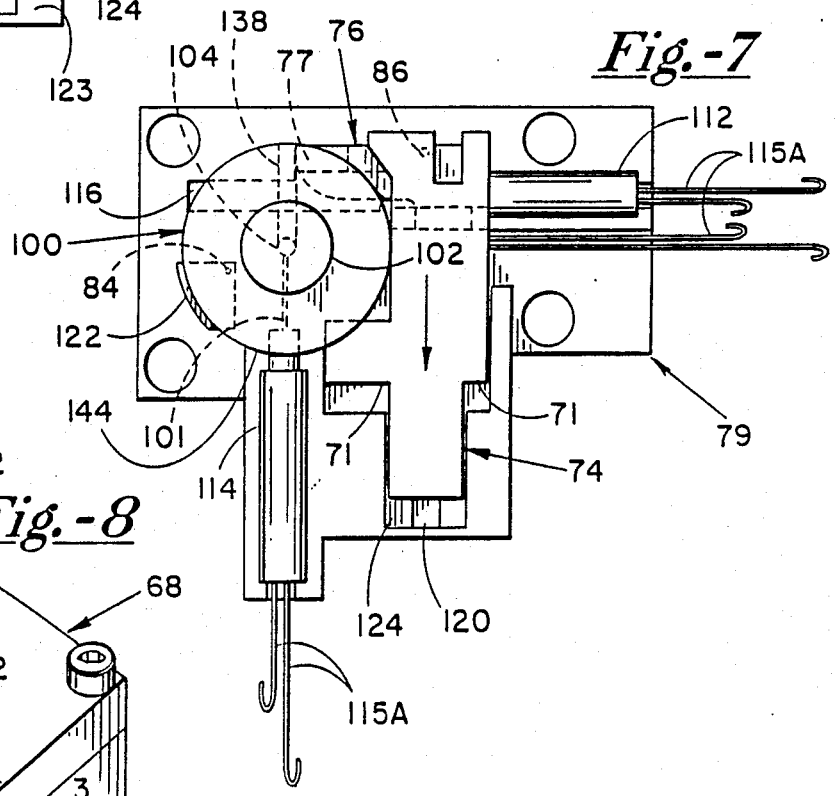
FIG. 7, top view of rotor base with piston actuators, rotor, enable transfer link, and cam installed prior to firing arm/fire piston actuator.
Figure 12:
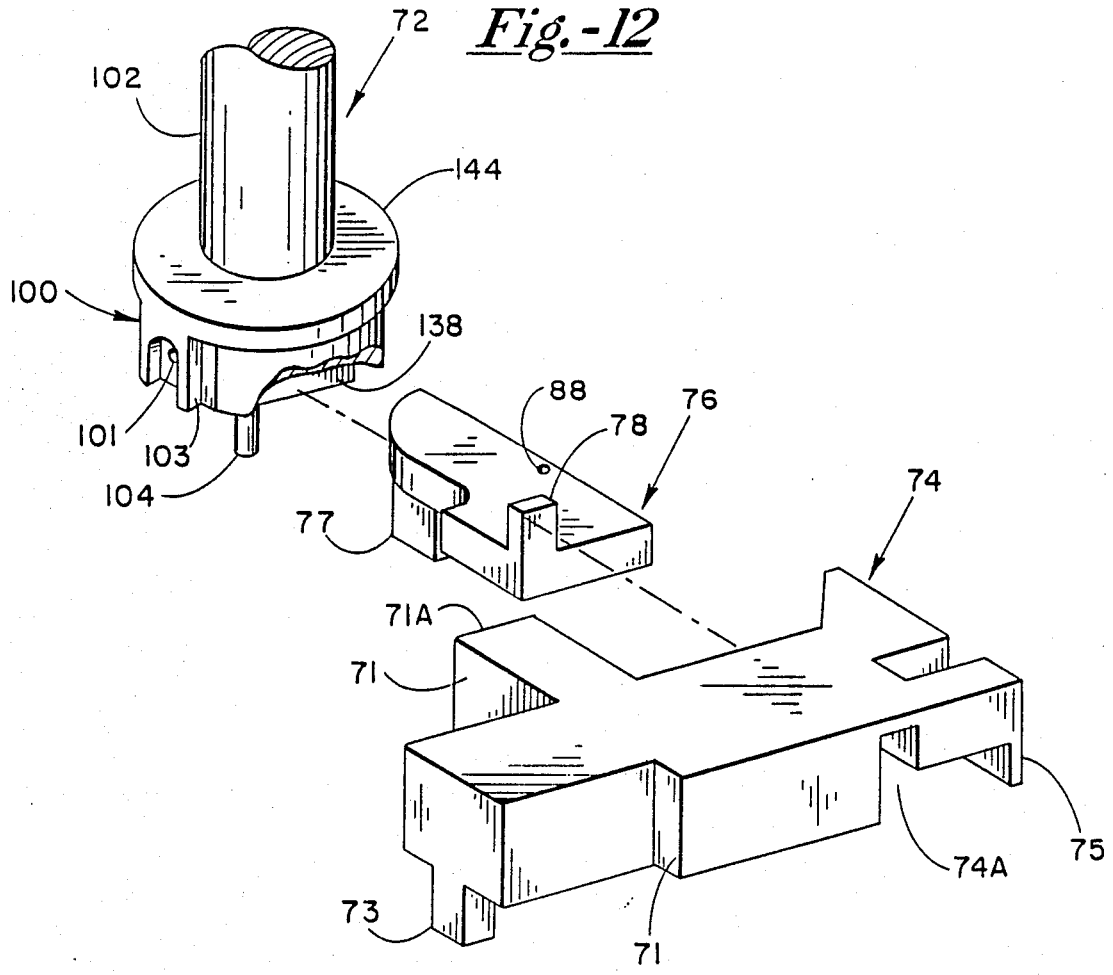
FIG. 12, perspective view of rotor end, cam, and enable transfer link showing their relative positions.
Figure 12A:
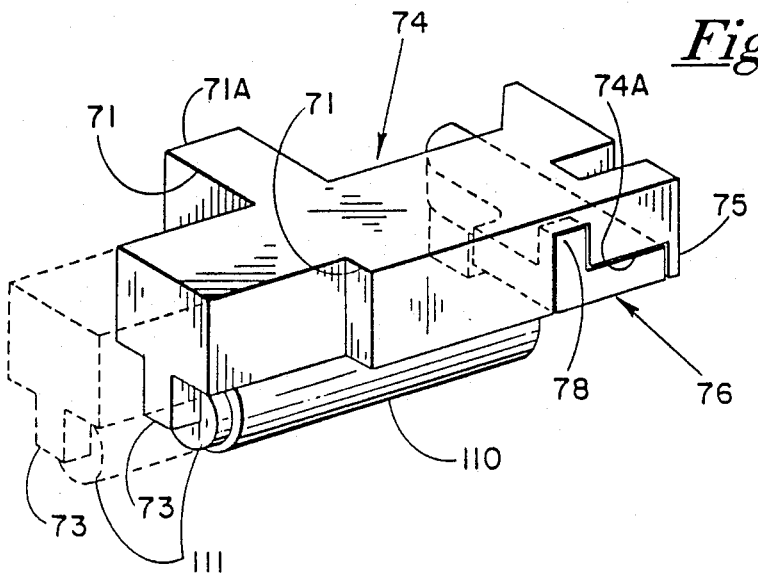
FIG. 12A, enable transfer link and piston actuator shown in solid lines before firing the piston actuator and the piston actuator in dashed lines after firing.

In FIG. 7, showing the next assembly step, arm/fire cam 76 is positioned with projection 77 held within chamber 118 by sheet wire 86 extending through hole 88 in the cam and into hole 90 in base 79. FIGS. 12, 16, 17, 18, and 19 show enable transfer link 74 with groove 74A, gripping projections 75, and stop projections 71 in detail. The mating relationship between arm/fire cam 76 and enable transfer link 74 is shown in FIG. 12A with the end of cam 76 having firing tang 78 slideably fit within the matching 74A in the underside of link 74. Projections 75 guide the side of cam 76 when cam 76 is slid within groove 74A.

Figure 17:
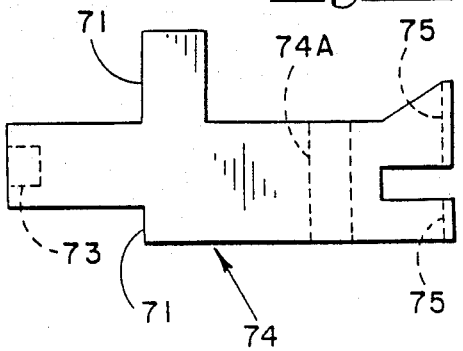
FIG. 17, top view of enable transfer link.
Figure 19:
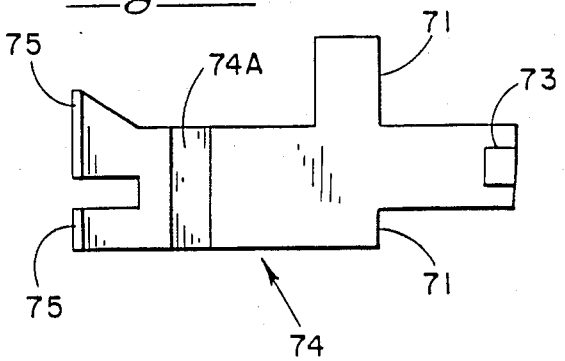
FIG. 19, bottom view of enable transfer link.

FIG. 6 shows channel 120 which is perpendicular to channel 116 and at the same depth to provide a guide for piston drive projection 73 of link 74. Extended portions 123 of rotor base 79 form a channel 124 which is the width of link 74 left of stop projections 71 as shown in FIG. 17 to provide a guide for the body of the link. In FIG. 7 enable transfer link 74 is shown positioned on top of the prepositioned cam 76, with projections 75 gripping the cam and link projection 73 extending into channel 120 next to adjacent piston 110, with the body of link 74 extending beyond stop projections 71 located within channel 124. Pin 104 of rotor 72 and sheer wire 82 are inserted into holes 106 and hole 84 respectively of base 79 and rotor 72 mounted with pin 82 in hole 84A to secure the rotor in the angular orientation shown. Guide projection 77 is offset within chamber 118 with the end of link 74 within channel 124, and projections 75 of the link engaging the side wall of the cam 76. Referring to FIG. 12 shoulder 103 of rotor 72 faces side 71A of enable transfer link 74, when these parts are mounted as shown in FIG. 7 side 71A of the link bearing against the shoulder prevents the rotor from rotating. This can also be seen in FIG. 9.

Figure 21:
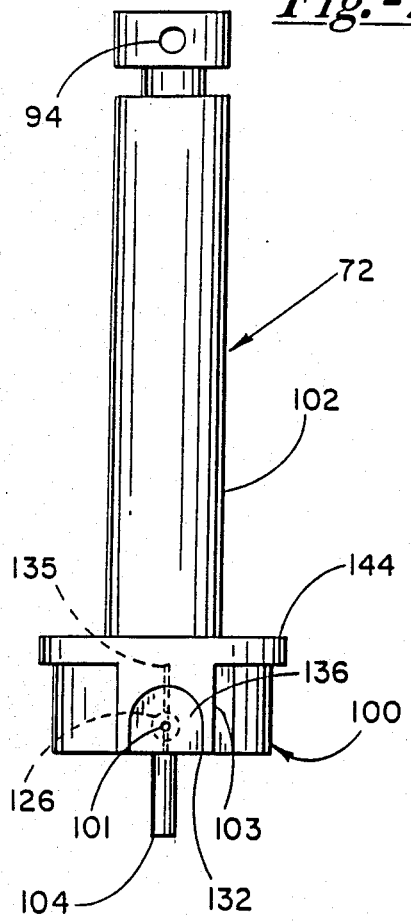
FIG. 21, side view of rotor.
Figure 22:
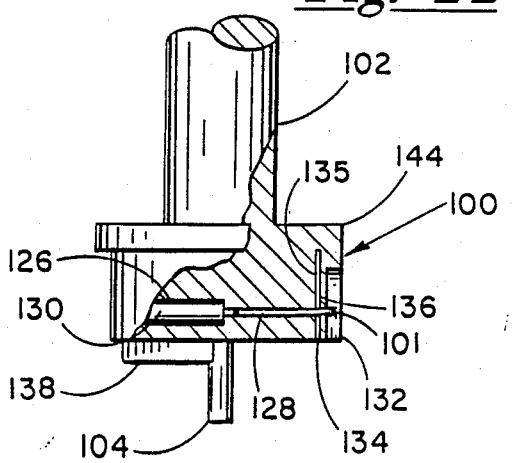
FIG. 22, cross-section of disc end of rotor.
Figure 23:
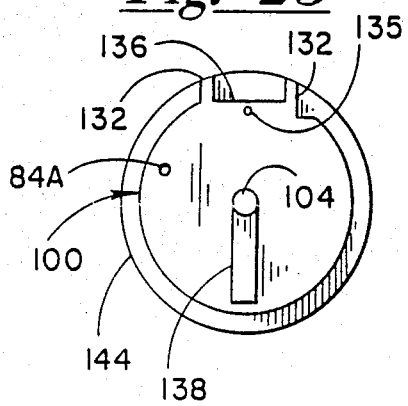
FIG. 23, disc end view of rotor.

FIG. 22 shows hole 128 extending half way through rotor 72 where it joins a larger hole 126. Hole 128 slideably holds a firing pin 101 and hole 126 holds a detonator 130. FIGS. 21, 22, and 23 show flanges 132 extending beyond firing pin 102 to protect against accidental firing. A safety wire 134 extends through hole 135 in disk 100 and an aligned hole in firing pin 101 to hold the pin to prevent any motion of the munition from driving the pin against the detonator 130.

Figure 9:
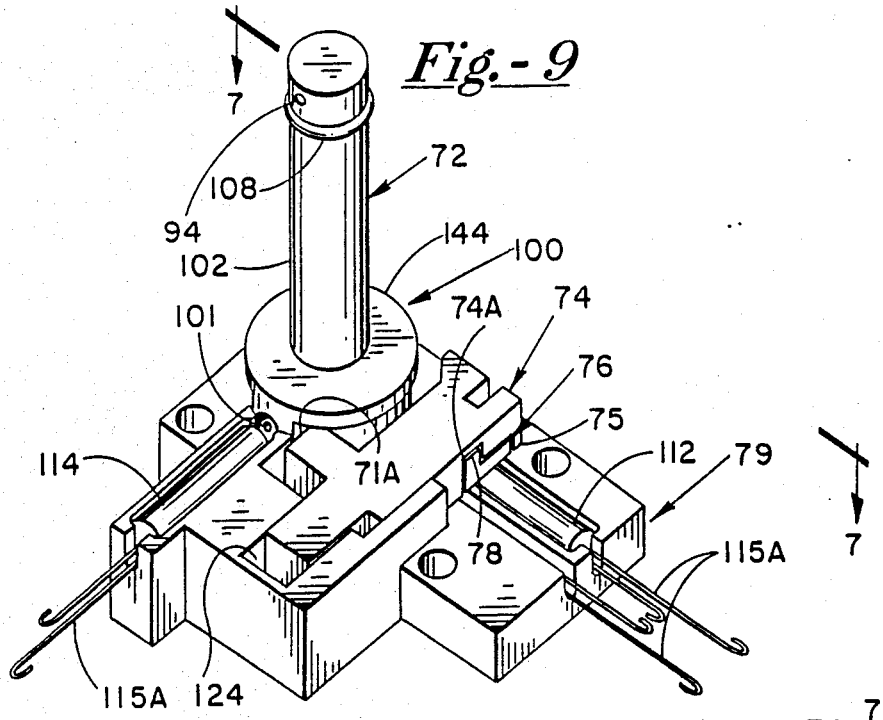
FIG. 9, perspective view of rotor base with associated parts installed.

FIG. 9 is a perspective view of these parts assembled with enable transfer link 74 in the initial position and firing pin 101 in rotor 72 aligned with piston 115 of piston actuator 114.

Figure 26:
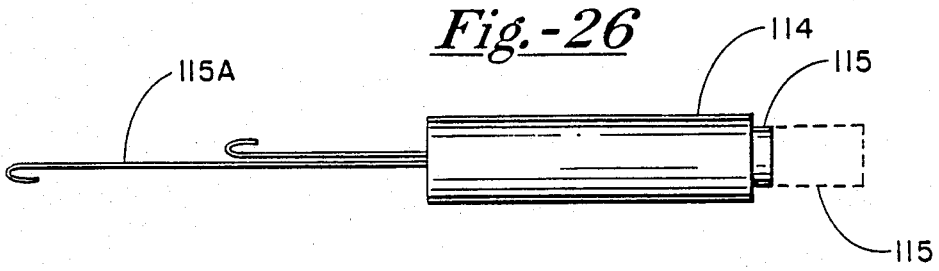
FIG. 26, explosive piston actuator before actuation in solid outline and after actuation in dashed outline.

FIG. 26 shows piston actuator 114 which is identical in operation to piston actuators 110 and 112. Here piston 115 of piston actuator 114 is shown before activation in solid lines and extended after activation in dashed lines. The end of piston 115 will fit within recess 136 in flanges 132 shown in FIGS. 21, 22, and 23 which permits piston 115 to strike firing pin 101 and detonate detonator 130.

Figure 24:
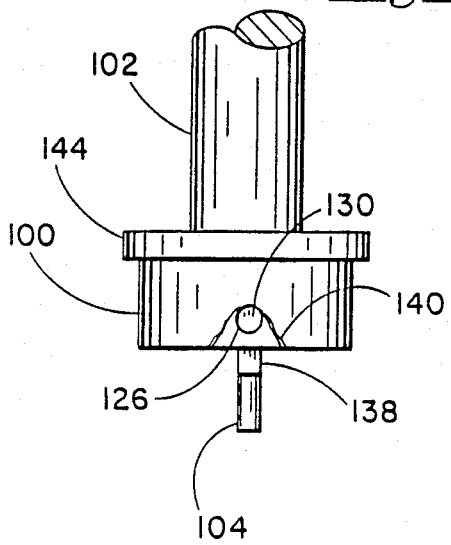
FIG. 24, side view of disc end of rotor showing fracture lines.

FIGS. 22, 23, and 24 show a bar 138, which is an integral part of rotor 72, extending downward from disk 100. Bar 138 is aligned with and immediately below detonator hole 126. A short fracture line path 140, shown in FIG. 24, results from having detonator hole 126 near the surface of disk 100. Firing detonator 130, located within hole 126, with no escape path, will cause disk 100 to separate along fracture lines 140 which will free bar 138 and pin 104 from the rest of the disk to allow the explosive force of the detonator to be directed outward. This will be described further in the description of the safing function. ARM/FIRE DESCRIPTION The following described enable and arm/fire description assumes that safety wire 36 has been removed to permit the rotation of rotor 72.

Figure 25:
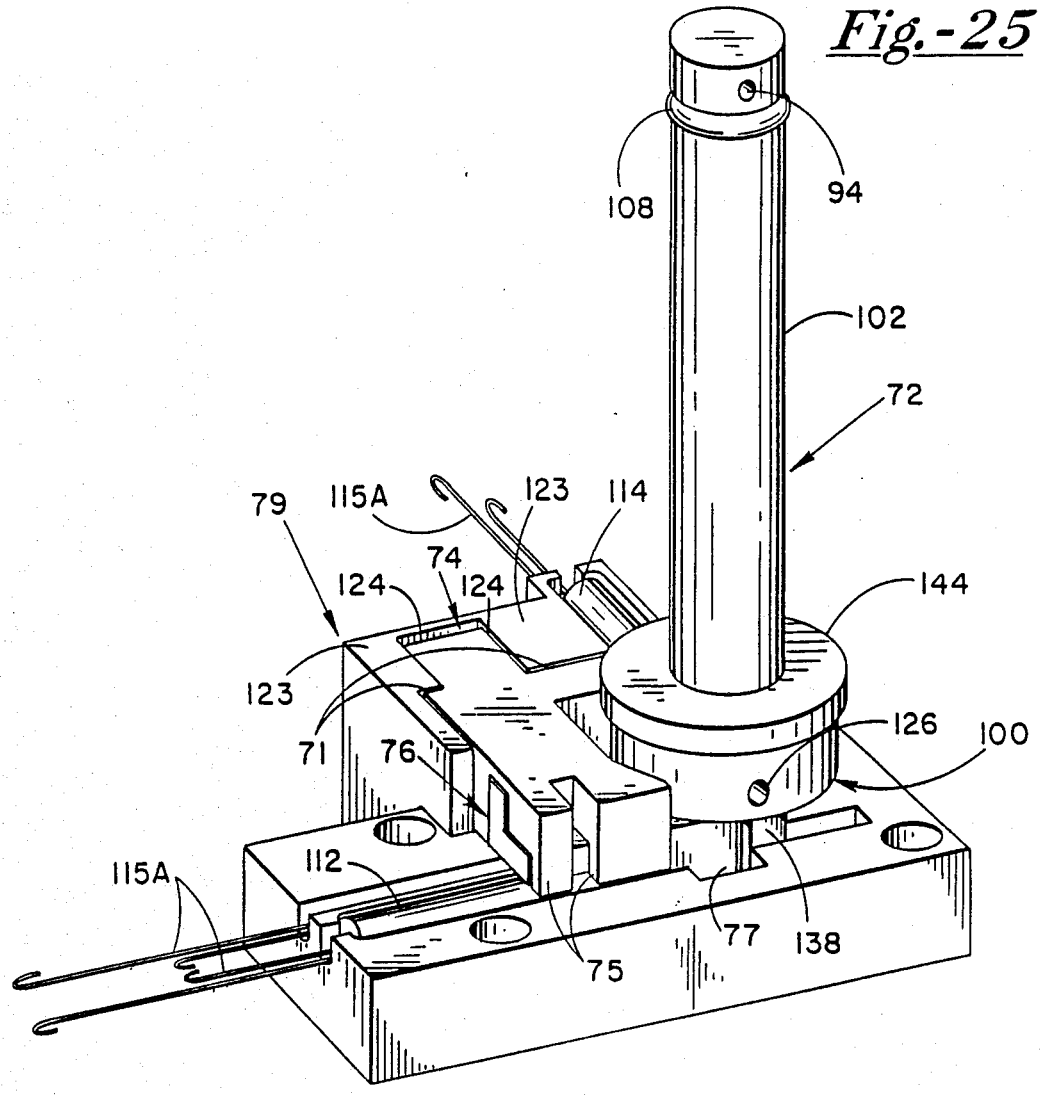
FIG. 25, perspective view of rotor base with associated parts after enable transfer link translation.

In FIG. 12A relative positions of enable transfer link 74, piston drive projection 73, piston actuator 110, and piston 111 which are the same as in FIG. 7, can be seen. Piston 111 is adjacent to and bears against projection 73 prior to firing and when fired will extend the piston leftward which will bear against projection 73 and translate link 74 leftward to the position shown in dashed outline. The result is shown in FIG. 25 where stop projections 71 of link 74 are forced against the elevated portion 123 of rotor base 79. Cam 76 is also carried by this motion of link 74 by projections 75 which results in guide projection 77 of the cam being moved out of chamber 118 into channel 116 and which also shears off sheer wire 86. When guide projection 77 was previously offset into chamber 118 piston 113 would bypass guide projection 77 and cam 76 would not be moved along channel 116, but with guide projection in channel 116 this motion is possible, since the projection is now aligned with the center line of piston 113 of piston actuator 112.

Figure 10:
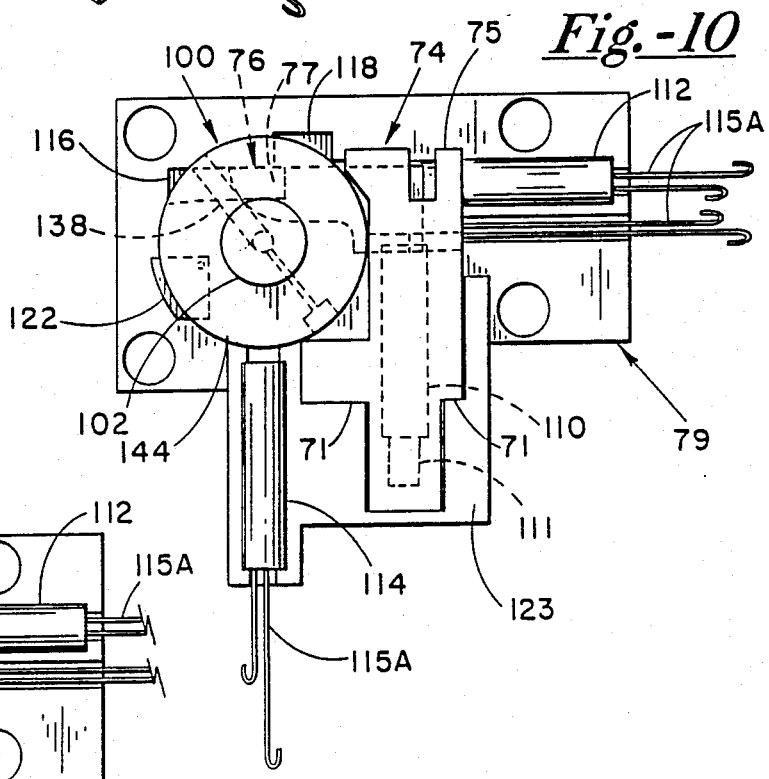
FIG. 10, top view of base showing relationship of parts with enable transfer link translated and with partially rotated rotor.

FIG. 10 shows piston actuator 112 after piston 111 has translated link 74 and cam 76 with piston 113 partially extended bearing against cam guide projection 77 carrying cam 76 leftward against bar 138. The end of cam 76 is rounded such that bar 138 will pivot around the cam and cause rotor 72 to rotate counterclockwise as shown. Here rotor 72 has been rotated approximately 45 degrees from the initial position by cam 76. This rotation has also sheared shear wire 82 which held the rotor in the initial assembled position.

Figure 11:
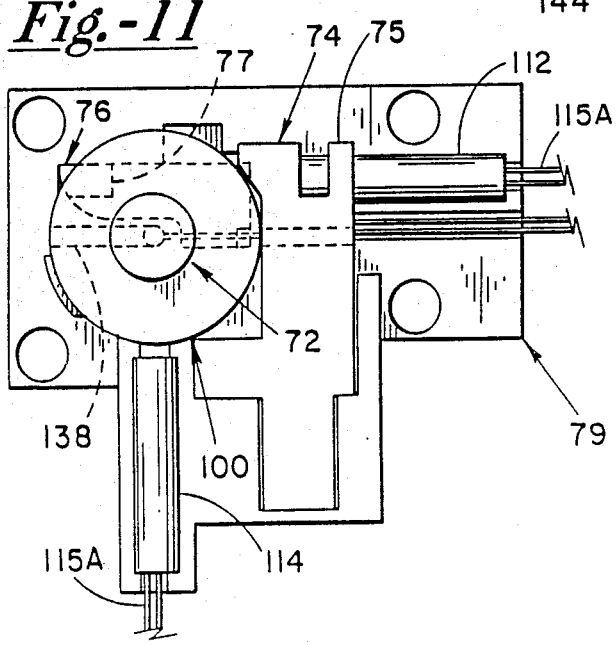
FIG. 11, top view of base with cam fully extended and rotor rotated 90 degrees.

In FIG. 11 cam 76 has been driven further leftward by piston 113 and has rotated bar 138 against stop quadrant 122 at an angle which aligns the rotor precisely at 90 degrees with respect to the initial angle. With rotor 72 at this angle hole 128 containing firing pin 101, not shown in this figure, is parallel with channel 116 which guides projection 77 and as cam 76 is forced leftward along this channel by piston 113 firing tang 78 projecting upward from the cam into the plane of the firing pin will strike the firing pin. This will shear wire 134 and drive the firing pin 101 leftward against detonator 130, not shown in this figure, in hole 126. With rotor 72 in this orientation detonator 130 is aligned with transfer lead 64, shown in FIG. 27, which will fire transfer lead 64 which in turn will fire main charge 66. As explained above, two steps are necessary in order to fire munition 10. First piston actuator 110 must be fired to translate enable transfer link 74 and move guide projection 77 from chamber 118 and align the projection with channel 116 opposite piston 113. This also moves projection 71A from shoulder 103 which unlocks rotor 72. Secondly piston actuator 112 must be fired to rotate rotor 72 by arm/fire cam 76 bearing against bar 138 to rotate rotor 72 ninety degrees and finally by tang 78 of the cam striking firing pin 101 to explode detonator 130.

In munition 10 a number of steps are necessary before safety wire 36 can be removed. These are described in my copending application on the safety ring. The safing function also called self-sterilization is separate from the arm and fire function and also requires removing safety wire 36. The firing a piston actuators 110 and 112 are part of the overall munitions system described in copending application Selectable Lightweight Attack Munition referenced in this application.

SAFING FUNCTION

Figure 20:
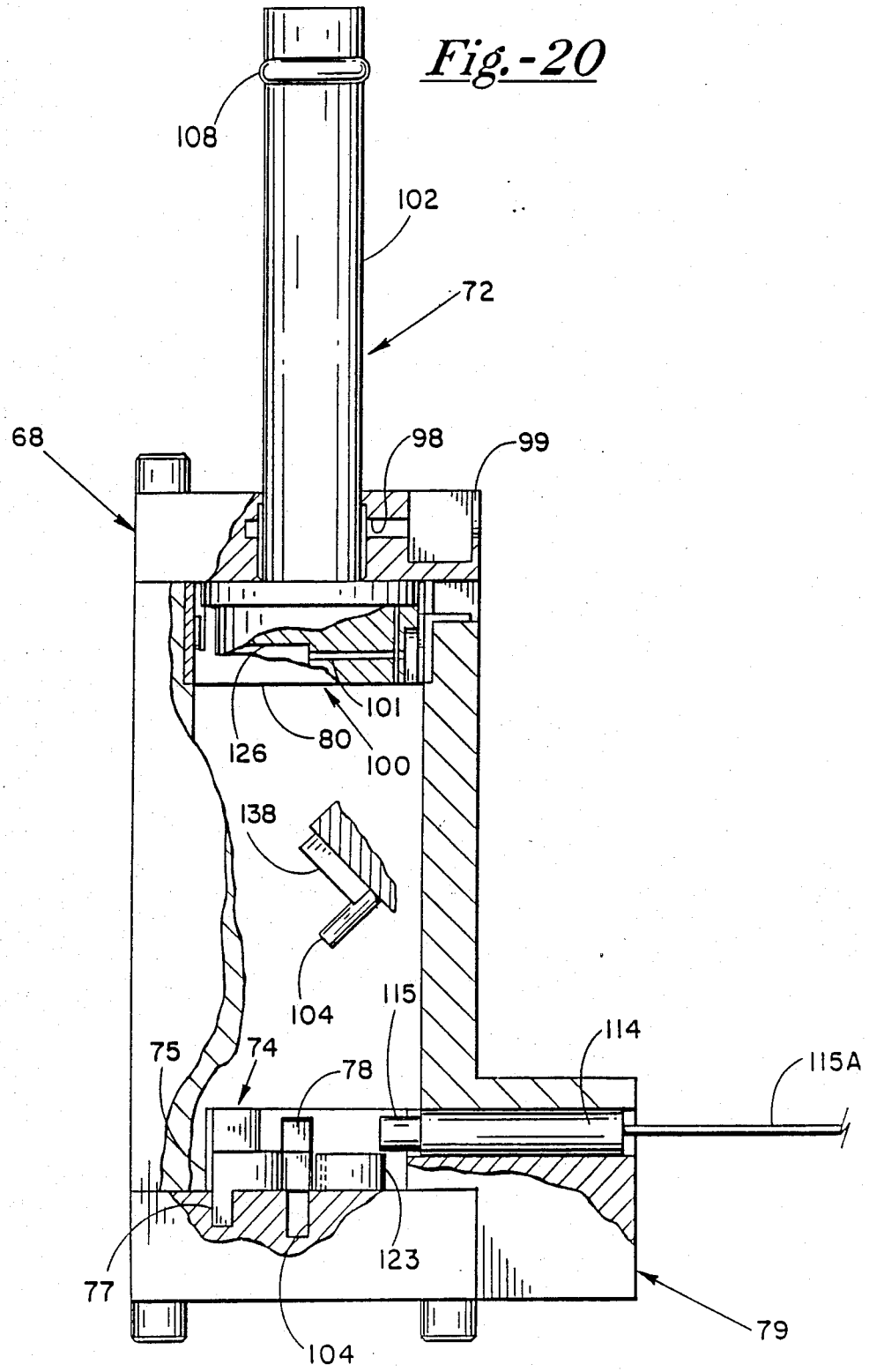
FIG. 20, cross-section of safe and arm/fire mechanism with rotor translated.

In FIG. 2 mechanism 60 is shown as assembled with firing pin 101 aligned with piston 115 of piston actuator 114. Post 102 extends upward into a hole 142 which extends into cap 68 leaving only a thin shell over the post. Safety wire 36 must be removed to permit this operation as shown in FIG. 20. Firing piston actuator 114 electrically will drive piston 115 against firing pin 101 which will drive the firing pin against detonator 130 and fire it. Detonator 130 bears against the inner wall of cylinder enclosure 70 and has no escape path for the explosion. This will cause disc 100 to fracture along the fracture line path 140 shown in FIG. 24 which will cause bar 138, pin 104 and the portion of disc 100 within fracture line path 140 to break away as shown in FIG. 20. This provides a path for the explosion outward from disc 100 which will drive the rotor upward within cylinder enclosure 70 and drive post 102 through cap 68. Disc 100 will not penetrate the thicker portion of area 68 extending outward from hole 142 which will stop rotor 72 with post 102 extended. Referring to FIG. 5 disc 100 has a ridge 144 extending outward from its upper edge. Latch spring 80 has two flanges extending horizontally which fit within notch 81 in cylinder enclosure 70 to secure the spring in place. The remaining flanges from spring 80 are vertical with alternate long and short flanges having the short flanges inclined inward. The long flanges of spring 80 are sized to just reach the top of the enclosure when the spring is mounted in place. When rotor 72 is driven upward with post 102 extending through cap 68 as shown in FIG. 20 the short flanges of spring 80 will fit under ridge 144 and secure rotor 72 in this translated position to provide a positive indication that detonator 130 has fired and firing pin 101 removed from the path of any piston actuators. This information permits using the munition in a manual firing mode which is explained in a copending application. The firing of piston actuator 114 is described in copending application Selectable Lightweight Attack Munition referenced in this application.

ADDITIONAL FEATURE

Figure 8:
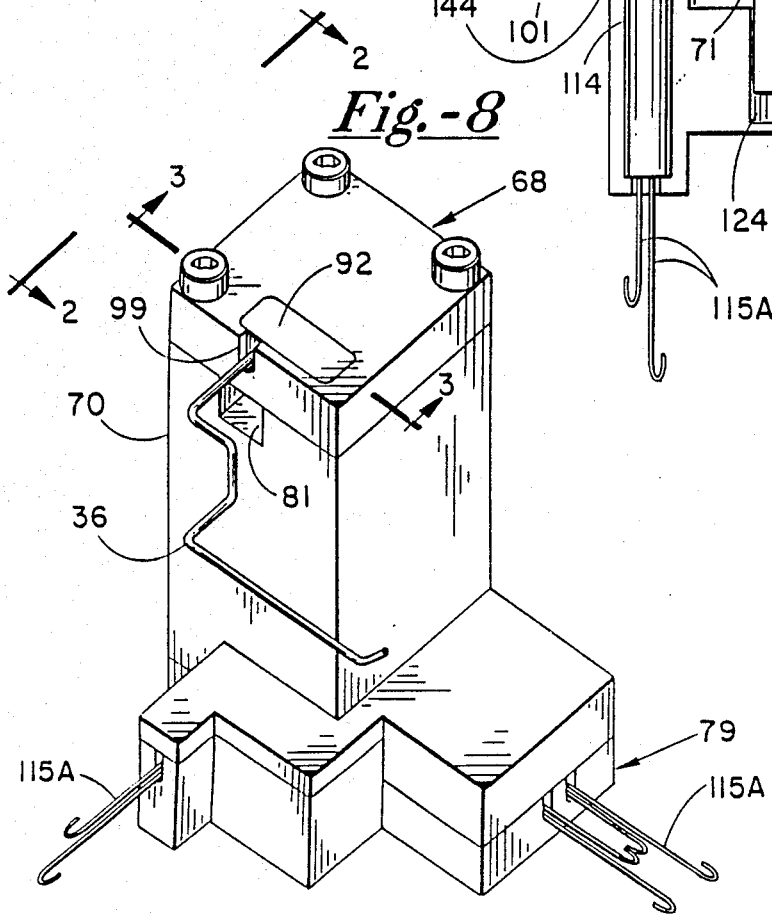
FIG. 8, perspective view of safe and arm/fire mechanism.

An additional feature to prevent tampering with munition 10 utilizes safety block 92. Block 92 is arranged such that if safety wire 36 is removed it cannot be reinserted. FIG. 8 shows safety wire inserted into safety block 92 through notch 99 which is recessed into a mating hole in the top of cap 68. FIG. 5 shows an indentation 146 in safety wire 36 which when in the center of safety block 92 prevents the safety wire sliding out and requires an intentional force to remove it. In FIG. 3 this indentation 146 is shown opposite cylindrical shaped plunger 148 which is forced leftward by coiling spring 150. Plunger 148 is slideably mounted within a channel extending lengthwise through safety block 92. When safety wire 36 is removed, as shown in FIG. 4, spring 150 urges cylinder 148 across hole 98 to prevent reinserting the wire through safety block 92.

SUMMARY

The mechanical arrangement of this invention provides a positive physical indication when the munition has been rendered safe by the outward extension of the post through the outer surface of the munition using the explosive force provided by detonator 130. Three separate mechanical parts prevent the rotor 72 from being rotated inadvertently; namely, sheer wire 82, safety wire 36 and face 71A of link 74 bearing against rotor shoulder 103. Two separate explosive piston driven operations are required in a correct sequence in order to enable and arm/fire the munition. Once removed safety wire 36 cannot be reinserted to prevent tampering with the munition by unfriendly personnel. The moving parts of this invention are made of steel however, any equivalent materials and manufacturing techniques resulting in the physical forms disclosed will result in a similarly functioning apparatus.

While this invention has been described with reference to an illustrative embodiment, this description is not intended to be construed in a limiting sense. Various modifications of the illustrative embodiment, as well as other embodiments of the invention, will be apparent to persons skilled in the art upon reference to this description. It is therefore contemplated that the appended claims will cover any such modifications or embodiments as fall within the true scope of the invention.

What is claimed is:

1. Apparatus for a portable munition comprising:

(a) a rotor having a circular shape and opposed pivot means extending from the center thereof and having a pair of aligned connected retaining holes extending completely through said rotor, in a plane perpendicular to a pivot axis through the pivot means; with said motor having a bar attached thereto as a portion containing a pivot axis with the bar extending radially outward from the pivot axis and in a plane perpendicular to the pivot axis;

(b) a detonator and firing pin mounted within the aligned connected retaining holes in said rotor with the retaining holes being dimensioned to fit said detonator and to slideably fit said firing pin respectively;

(c) an enclosure having circular shaped interior rotor space oriented and dimensioned to accommodate said rotor, said rotor being pivotably mounted therein by the opposed pivot means; and having interior base space interconnected to the rotor space adjacent to the axis of said rotor containing the attached bar; and having an outside opening through a wall of said enclosure adjacent said rotor;

(d) a cam located within the base space having first guide means within the base space relative to said enclosure with the first guide means and the cam dimensioned located and arranged such that said cam can be guided along a linear first guide path by the first guide means, which is located in a guide plane perpendicularly oriented to the pivot axis, with the first guide path extending from a first location which is more distant from the pivot axis than said rotor, thence along a line adjacent to the pivot axis and near said rotor to a second location, which is beyond said rotor; with the first guide path, said cam, said rotor and the bar dimensioned and located such that as said cam moves from said first location to said second location, said cam will strike the bar only, and cause said rotor to rotate from a first angular position to a second angular position relative to said enclosing means; and with the retaining holes within said rotor oriented with respect to said enclosing means such that with said rotor located in said second angular position, relative to said enclosing means, said retaining holes are oriented generally parallel to said first guide path with the opening for said firing pin retaining hole facing in the general direction of the first position of the first guide path;

(e) first rotor stop means comprising an extension from said enclosure within said base space arranged to prevent said rotor from rotating beyond the second angular position with respect to said enclosure;

(f) first actuator means located within the base space and attached to said enclosure adjacent to said cam, when said cam is in said first position in said first guide path; and first actuator means arranged such that when activated said first actuator means can drive said cam along said first guide path from said first position to said second position;

(g) a tang extending from said cam along a line generally parallel to said pivot axis and directed toward said rotor, with said tang offset from said first guide path toward said pivot axis; having said tang, said cam, said bar, said first guide path, and said firing pin dimensioned and located such that, as said cam traverses the first guide path from the first position to the second position said tang will be carried along a tang path which is parallel to the first guide path but which will intersect the pivot axis, such that after said cam has struck the bar and rotated said rotor to the second angular position; said tang will then strike the end of said firing means facing towards the first position of the first guide path and drive said firing pin against and explode said detonator;

(h) said enclosure outside opening being aligned with said detonator when said rotor is located in the second angular position;

(i) explosive means located outside the enclosure adjacent the outside opening arranged such that, when said rotor is located in the second angular position, a detonator explosion will cause said explosive means to explode.

2. Apparatus as in claim 1 with the enclosure and the firing pin having aligned holes when said firing pin is adjacent to said detonator prior to firing which are oriented perpendicularly to said firing pin, the holes being sized to hold, and holding a first safety wire.

3. Apparatus as in claim 1 with said cam having a rounded corner on the portion first impacting the bar such that the rotation of the bar about the cam is facilitated.

4. Apparatus as in claim 1 and further including said rotor and said enclosure having aligned matching holes, when said rotor is in the first angular position with respect to said enclosure, the holes being sized to hold, and holding, a second safety wire.

5. Apparatus as in claim 1 wherein the rotor stop means comprises an extension from the enclosure which bar strikes in the second angular position.

6. Apparatus as in claim 1 wherein said first actuator means comprises a first explosive piston actuator, mounted in a linear extension of a first guide channel corresponding to the first guide path, oriented from said guide plane perpendicular to and away from said rotor and extending from the first position of the first guide channel away from the rotor; with the first explosive piston actuator arranged such that; when activated, the piston of the first explosive piston actuator can drive a guide projection attached to said cam and extending into said first guide channel, from the first to the second position along the first guide channel.

7. Apparatus as in claim 1 whereby:

(a) first guide means comprises a first guide channel corresponding to said first guide path, with the first guide channel extending perpendicularly to the first plane in a direction away from said rotor, said cam having a guide projection which is oriented generally parallel to both the rotor axis and the first guide channel and directed away from said rotor with the guide projection slideably engaged by the first guide channel;

(b) the first actuator means comprising a first explosive piston actuator mounted in a linear extension of the first guide channel extending from the first position of the channel away from the rotor with the first actuator arranged such that when activated the piston of the first explosive piston actuator can drive the guide projection and attached cam from the first to the second position along the first guide channel;

(c) a chamber extending from the surface of the first plane surface being located adjacent to, connected with, offset from, and having the same depth and orientation as the first guide channel; with said chamber sized and located such that the guide projection from said cam can be offset from the first channel within said chamber when said cam is adjacent the first position of the first guide channel;

(d) an enable transfer link located within the base space having second actuator engaging means and cam engaging means with the cam engaging means arranged such as to permit the enable transfer link to move said cam in a direction perpendicular to the first guide path but allow said cam to move freely in a direction parallel to the first guide path with respect to said enable transfer link;

(e) second guide means for said enable transfer link arranged such that said enable transfer link can be guided along a linear second guide path perpendicular to the first guide path on the guide plane, extending from a first position to a second position in the guide plane; with said enable transfer link, the guide projection, the cam engaging means, said cam and the second guide path located and dimensioned such that, with the enable transfer link in the first position in the second guide path, with the guide projection from said cam located in said chamber, with said enable transfer link engaging means engaging said cam, then when said enable transfer link is moved to the second position along the second guide path, the guide projection of said cam will be moved from the chamber to the first channel adjacent the first explosive piston actuator;

(f) a second actuator and a second actuator enable transfer link engaging means being arranged such, that said second actuator when activated will drive said enable transfer link from the first to the second position along the second guide path;

(g) second enable transfer link stop means extending from said enclosure in the base space arranged to prevent said enable transfer link from moving beyond the second position with respect to said enclosure along the second guide path.

8. Apparatus as in claim 7 whereby the rotor has a circular protective flange extending outwardly about the firing pin hole a distance slightly greater than the extension of the firing pin, the flange being arranged such as to permit striking the firing pin along the axis thereof, but only after penetrating within the flange.

9. Apparatus as claim 7 with said cam and said enclosure having aligned matching holes, when the cam guide is offset to the chamber, sized to hold and holding a third safety wire.

10. Apparatus as in claim 7 wherein the second actuator engaging means comprises a piston drive projection extending from the enable transfer link in a direction opposite from the rotor into a matching piston drive slot parallel to the second guide path arranged; such that as the enable transfer link moves from the first to the second position along the second guide path the piston drive projection will slide along the piston drive slot.

11. Apparatus as in claim 10 wherein the second actuator meams comprises a second explosive piston actuator with said piston drive slot extending beyond the first position away from the second position and sized to hold said second explosive piston actuator arranged to drive the piston and said enable transfer link from the first to the second position along the first guide path.

12. Apparatus as in claim 7 wherein said second guide means comprises a pair of opposed parallel surfaces extending perpendicularly from the enclosure within the base space from the guide plane to a transfer link plane which is parallel to the first guide plane, but offset towards the rotor; and with said enable transfer link having an outward projection sized and located to slideably fit and extending within the opposed parallel surfaces which are dimensioned and located; such that the enable transfer link is guided from the first to the second position on the second guide path by the enable transfer link outward projection sliding within the opposed parallel surfaces.

13. Apparatus as in claim 12 with said rotor in the first angular position having a notch in the surface facing the adjacent outward extension of the enable transfer link, when located in the first position within the second guide path; the adjacent outward extension dimensioned such that the portion of the shoulder extending from the enable transfer link towards said rotor will extend into the notch to prevent the rotor from being rotated, until the enable transfer link has been moved from the first to the second position along the second guide path.

14. Apparatus as in claim 13 wherein said enable transfer link stop means comprises outward extensions extending outward beyond the parallel surfaces from the enable transfer link, arranged to strike the ends of the parallel surfaces to prevent the enable transfer link from moving beyond the second position on the second guide path.

15. Apparatus as in claim 7 whereby:

(a) said rotor is comprised of a disk with the opposed pivot means extending from the center of opposite surfaces of the disk and with the opposed pivot means comprising a circular shaped post smaller than the disk and a pin, all attached together along each axis of symmetry, which coincides with the pivot axis of said rotor and with the bar attached to the disk adjacent the pin;

(b) said rotor space of said enclosure having a cylindrical shape with the axis of the cylinder shape corresponding to the pivot axis of said rotor with said enclosure having centered, opposed, outwardly directed holes in each end of the cylinder shaped rotor space, with the respective centered holes sized to rotatably hold the post and pin respectively of said rotor, and with the diameter of the cylinder shape being slightly larger than the diameter of the disk and with the length of the cylinder shape being long enough to accommodate said rotor with the post and pin recessed in their respective outwardly directed holes;

(c) third actuator means positioned adjacent to and aligned with said firing pin when said rotor is in the first angular position relative said enclosing means having said third actuator, said firing pin and said rotor located, dimensioned and arranged such that said third actuator when activated can strike said firing pin and drive the firing pin against said detonator;

(d) the cylinder shaped wall of said cylindrical shaped enclosing space adjacent said detonator, when said rotor is in the first angular position relative to the cylindrical shaped enclosing means, spaced close enough to said detonator such that said cylindrical shaped wall will provide a seal for any detonator explosion such that said detonator explosion will be contained by the cylinder shaped wall;

(e) the hole containing the detonator means located closer to the disk surface having the attached bar than the opposite disk surface, and being arranged and dimensioned such that a contained detonation explosion will blast an opening in the disk surface containing the bar;

(f) said rotor, said enclosure and the rotor space, dimensioned and arranged such as to permit said rotor to be translated with respect to said enclosure means by the contained detonation explosion expanding within the base space adjacent the disk surface containing said bar, after said opening is blasted in said disk surface by said contained detonation; said rotor being translated from a first position where said rotor is pivotably mounted within said cylinder shaped enclosing space with the rotor disk adjacent to a first end of the cylinder shaped enclosure, to a second position where the disk is adjacent to the opposite end of the cylinder shaped enclosure; with the post extending through the portion of the enclosure opposite the post, the wall opposite the post only being thinner to permit only the post to penetrate the wall; and (g) securing means to hold said disk of said rotor in said second translated position with said post extended through said wall of said enclosing means.

16. Apparatus as in claim 15 wherein the post securing means comprises a generally cylindrical shaped spring sized to mate with the cylinder shaped rotor enclosure and mounted therewithin with the cylinder and spring axis aligned; and having a portion of said spring extending outward and engaging a recess in the enclosure to hold the spring adjacent the end of the cylinder adjacent the post, with the periphery of the spring adjacent the cylinder end having alternate long segments reaching the end of the cylinder space, and short segments inclined inward; and with the disk having an extending ridge about the periphery adjacent the post, such that with the disk adjacent the post recess, the short spring segments will incline inward within the ridge and secure the disk in place.

17. The apparatus as in claim 15 with the post having a gland located in a recess completely about the periphery and adjacent the post recess with the rotor pivotably mounted within the enclosure, arranged such that the interior of the enclosure is sealed from the outside about the post.

18. Apparatus as in claim 15 with said rotor post and said enclosure having opposed aligned matching holes, when said rotor rotatably mounted in said first angular position having a fourth safety wire extending therethrough; having sufficient strength such that said rotor cannot be rotated or translated by the force available from a piston actuator or detonator without first removing said fourth safety wire.

19. Apparatus as in claim 18 with a safety block enclosure recessed within the wall of the enclosure and having aligned holes therethrough, with the holes in the safety block having the same size and the block located to be aligned with the holes for and containing the fourth safety wire extending through the enclosure, the safety wire also extending through the holes in the safety block; with the safety block enclosure having a spring loaded plunger located therein and arranged such that when the fourth safety wire is removed, the spring will urge the plunger across the safety wire holes and prevent reinserting the fourth safety wire.

* * * * *